United States Patent [19]

Takagi

[11] Patent Number: 4,827,869

[45] Date of Patent: May 9, 1989

[54] SINGLE AND MULTI-COLOR DEVELOPING APPARATUS

[75] Inventor: Osamu Takagi, Tokyo, Japan

[73] Assignee: Kabushiki Kaisha Toshiba, Kawasaki, Japan

[21] Appl. No.: 100,040

[22] Filed: Sep. 23, 1987

[30] Foreign Application Priority Data

Sep. 30, 1986 [JP] Japan ..... 61-231781

[51] Int. Cl.[4] ..... G03G 15/01

[52] U.S. Cl. ..... 118/645; 118/651; 118/653; 355/326; 355/265

[58] Field of Search ..... 118/645, 653, 651; 355/3 DD, 4

[56] References Cited

U.S. PATENT DOCUMENTS

| | | | |
|---|---|---|---|
| 3,705,767 | 12/1972 | Tamai et al. | 118/645 X |
| 4,398,817 | 8/1983 | Nishimura et al. | 355/3 DD X |
| 4,416,533 | 11/1983 | Tokunaga et al. | 355/3 DD X |
| 4,591,261 | 5/1986 | Saruwatari et al. | 355/4 |
| 4,653,426 | 3/1987 | Kohyama | 118/651 |
| 4,662,311 | 5/1987 | Shoji et al. | 118/651 |
| 4,674,441 | 6/1987 | Kohyama | 118/651 X |
| 4,710,016 | 12/1987 | Waatanabe | 355/74 D X |
| 4,734,735 | 3/1988 | Haneda | 355/3 DD X |

FOREIGN PATENT DOCUMENTS

| | | | |
|---|---|---|---|
| 160273 | 4/1985 | European Pat. Off. . | |
| 2944986 | 11/1979 | Fed. Rep. of Germany . | |
| 0124732 | 9/1979 | Japan | 355/4 |
| 0198252 | 9/1986 | Japan | 355/4 |
| 2030478 | 7/1979 | United Kingdom . | |

*Primary Examiner*—Shrive Beck
*Assistant Examiner*—Alain Bashore
*Attorney, Agent, or Firm*—Foley & Lardner, Schwartz, Jeffery, Schwaab, Mack, Blumenthal & Evans

[57] ABSTRACT

An apparatus includes first and second developing sleeves which are sequentially arranged in this order along a rotational direction of a photosensitive body to face the photosensitive body. The first developing sleeve has a first diameter, carries a layer of a first toner on its surface, and causes layer of the first toner to face a first latent image upon rotation thereof. The second developing sleeve has a second diameter larger than the first diameter, carries a layer of a second toner on its surface, and causes the layer of the second toner to face a second latent image upon rotation thereof after the layer of the first toner is caused to face the first latent image. A superposed developing bias voltage of DC and AC is applied between the photosensitive body and the first developing sleeve, so that the first toner flies from the first developing sleeve to the photosensitive body to develop the first latent image. A DC developing bias voltage is applied between the photosensitive body and the second developing sleeve, so that the second toner flies from the second developing sleeve to the photosensitive body to develop the second latent image.

8 Claims, 4 Drawing Sheets

SINGLE AND MULTI-COLOR DEVELOPING APPARATUS

BACKGROUND OF THE INVENTION

The present invention relates to a developing apparatus capable of recording images in two or more colors and, more particularly, to a developing apparatus having a plurality of developing units, each for forming a thin one-component toner layer on the surface of a developing sleeve, which can be set in a multi-color recording mode and a single-color recording mode.

In order to record images in two or more colors on a photosensitive body by means of a developing apparatus of this type, different bias voltages are applied to the developing sleeves of the developing units.

That is, to record an image in the first color, a developing bias voltage, obtained by superposing an AC bias voltage on a DC bias voltage, is applied to a developing sleeve of a first developing unit. To record the same image in the second color on the first-color image, however, a DC bias voltage is applied to the developing sleeve of a second developing unit for the second color so that toner particles of the first color on the photosensitive body do not fly to the developing unit of the second color.

When the DC developing bias voltage is applied to the developing sleeve, developing efficiency, i.e., developing agent flying efficiency per unit area of the developing sleeve is lower than in the case where the developing bias voltage, obtained by superposing the AC developing bias voltage on the DC developing bias voltage, is applied to the developing sleeve. For this reason, less developing agent needs to be supplied to the photosensitive body during development of the second than during development of the first color. Therefore, the second-color image is inevitably less dense than the first-color image, making it difficult to obtain a good image.

SUMMARY OF THE INVENTION

It is an object of the present invention to provide a developing apparatus in which the image developed by a second developing means has the same density as the image developed by a first developing means, thereby obtaining a good multi-color image.

According to an aspect of the present invention, there is provided a developing apparatus for developing an electrostatic latent image carried on a movable image carrier, comprising:

first developing means for applying a first developing agent on the electrostatic latent image, said first developing means having a first curved surface with a first curvature so as to carry a layer of the first developing agent thereon and said first developing means being disposed to cause the layer of the first developing agent to face the movable image carrier in accordance with the movement thereof;

second developing means for applying a second developing agent on the electrostatic latent image, said second developing means having a second curved surface with a second curvature less than the first curvature so as to carry a layer of the second developing agent thereon and said second developing means being disposed to cause the layer of the second developing agent to face the movable image carrier in accordance with the movement thereof after the layer of the first developing agent has faced the movable image carrier; and means for applying a first developing bias voltage between the image carrier and said first developing means so as to transfer the first developing agent from the first curved surface to the image carrier, and applying a second developing bias voltage between the image carrier and said second developing means so as to transfer the second developing agent from the second curved surface to the image carrier, thereby the first and second developing agent are overlappingly deposited on the electrostatic latent image. Even if developing agent flying efficiency per unit area of the second developing means is lower than that of the first developing means, developing agent can be supplied from the second developing means to the image carrier in the same amount as that supplied from the first developing means to the image carrier since the developing agent flying area of the second developing means is larger than that of the first developing means.

DETAILED DESCRIPTION OF THE PREFERRED EMBODIMENT

A preferred embodiment of the present invention will be described below with reference to the accompanying drawings.

Figure 1:
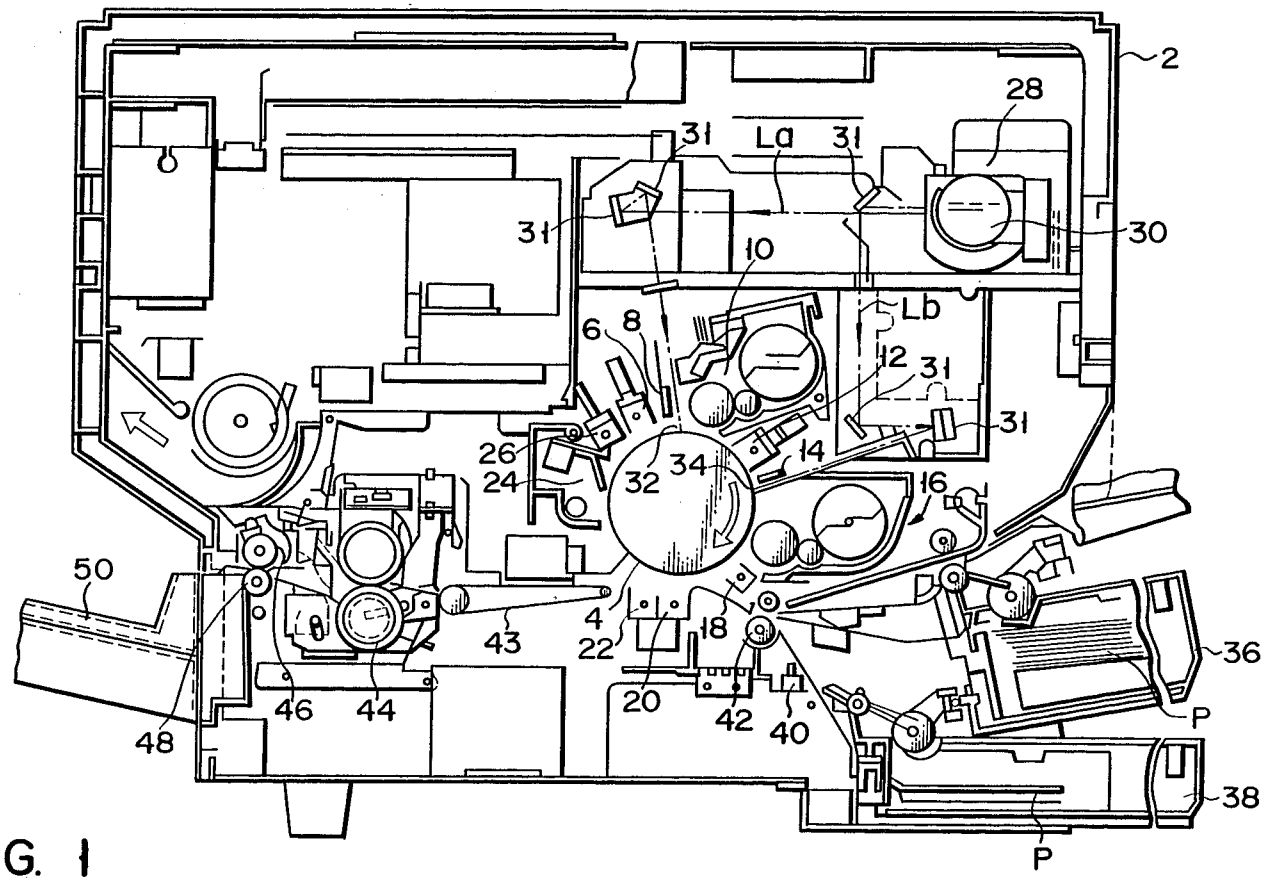
FIG. 1 is a sectional view schematically showing an embodiment of a recording apparatus having a developing apparatus according to the present invention.

In FIG. 1, reference numeral 2 denotes a housing of a recording apparatus having a developing apparatus according to the present invention. Drum-like photosensitive body 4 is provided at substantially the center of housing 4 and rotatable in a direction indicated by an arrow. First charger 6, first surface potential sensor 8, first developing unit 10, second charger 12, second surface potential sensor 14, second developing unit 16, pretransfer charger 18, transfer charger 20, separation charger 22, cleaner 24, and discharger 26 are sequentially arranged around photosensitive body 4 in a rotation direction thereof.

Scanner unit 28 is provided at an upper portion of housing 2. In scanner unit 28, information light is generated from an information light generator (not shown), scanned by polygon mirror 30, and guided to first and second exposure positions 32 and 34 on photosensitive body 4 through a plurality of mirrors 31. First position 32 is set on photosensitive body 4 between first sensor 8 and first developing unit 10, and second position 34 is set on photosensitive body 4 between second sensor 14 and second developing unit 16.

Upper paper feed cassette 36 and lower paper feed cassette 38 are mounted on one lower side portion of housing 2. Sheet P is selectively fed from cassettes 36 and 38. Sheet P is fed between photosensitive body 4, transfer charger 20, and separation charger 22 through paper detector 40 and register roller pair 42, and is further fed to paper discharge tray 50 through conveyor belt 43, fixer 44, paper discharge switch 46, and paper discharge roller pair 48.

When two-color recording is to be performed, the surface of photosensitive body 4 is uniformly charged to have a voltage of, e.g., 600 V by first charger 6, and then a surface potential of photosensitive body 4 is detected by first sensor 8. Thereafter, the surface of photosensitive body 4 at first position 32 is exposed with first information light La from scanner unit 28. As a result, a first electrostatic latent image is formed on photosensitive body 4. This first latent image is developed by first developing unit 10 to form a first toner image. Then, the surface of photosensitive body 4 carrying the first toner image is charged to have a voltage of 1,000 V by second charger 12. Thereafter, the surface potential of photosensitive body 4 is detected by second sensor 14, and then the surface of photosensitive body 4 at second position 34 is exposed with second information light Lb from scanner unit 28. As a result, a second electrostatic latent image is formed on photosensitive body 4. The second latent image is developed by second developing unit 16 to form a second toner image. Then, the surface of photosensitive body 4 carrying the first and second toner images is charged by pretransfer charger 18. The first and second toner images are simultaneously transferred to sheet P by transfer charger 20. Thereafter, sheet P is separated from photosensitive body 4 by separation charger 24, and transported to fixer 44 by belt 42. The first and second toner images are fixed on sheet P by fixer 44. Then, sheet P is discharged to tray 50.

Figure 2:
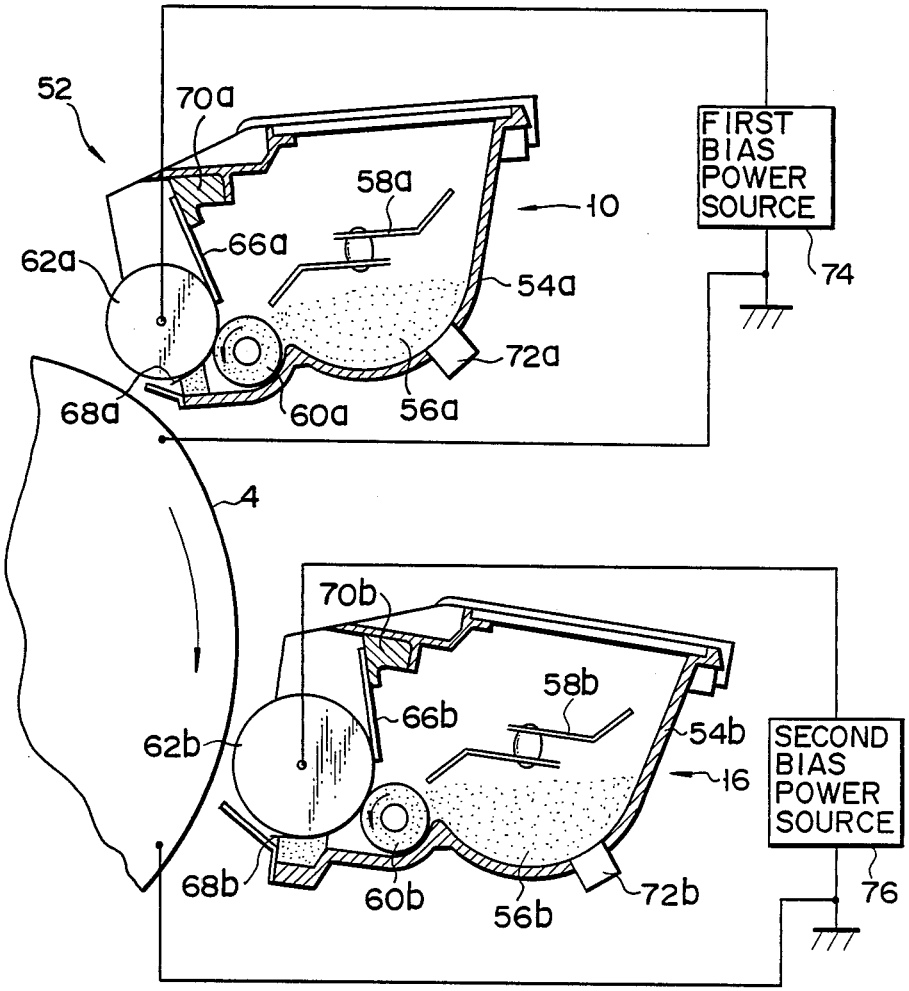
FIG. 2 is a sectional view showing a developing apparatus of the apparatus shown in FIG. 1.
Figure 3:
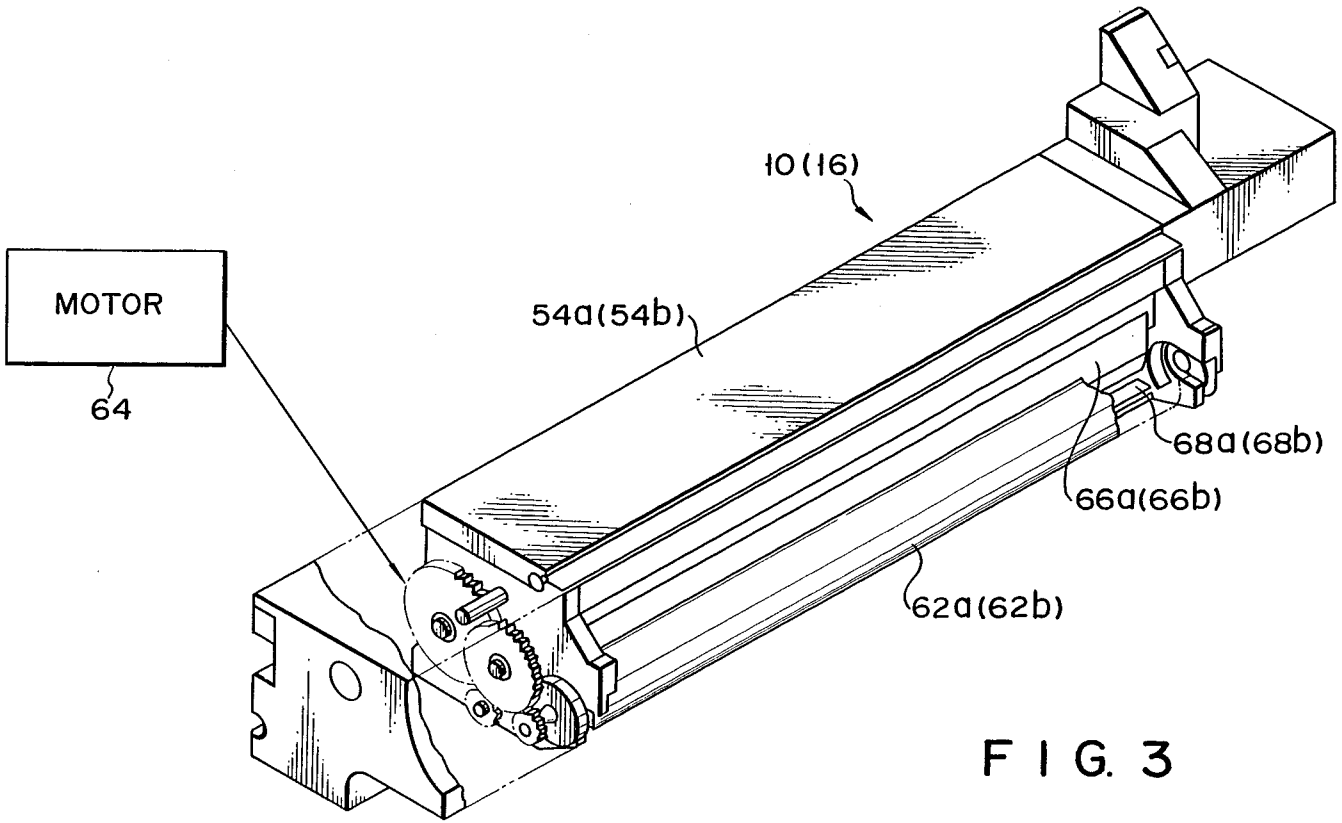
FIG. 3 is a perspective view of a developing unit of the developing apparatus shown in FIG. 2.

Developing apparatus 52 having first and second developing units 10 and 16 will be described below. As shown in FIGS. 2 and 3, developing units 10 and 16 have cases **54*a* and 54*b*, respectively. One-component nonmagnetic black toner 56*a* as a developing agent is stored in case 54*a*, and one-component nonmagnetic red toner 56*b* is stored in case 56*b*. Toner agitators 58*a* and 58*b*, toner supply rollers 60*a* and 60*b*, and developing sleeves 62*a* and 62*b* are respectively disposed in case 54*a* and 54*b*. Developing sleeves 62*a* and 62*b* carry and transport the layer of toners 56*a* and 56*b* on their surfaces so that the layer of toners 56*a* and 56*b* face photosensitive body 4, and are rotated at a peripheral speed substantially the same as that of photosensitive body 4 by motor 64. Coating blades 66*a* and 66*b* and recovery blades 68*a* and 68*b* are also provided in cases 54*a* and 54*b*, respectively. Coating blades 66*a* and 66*b* apply toners 56*a* and 56*b* to the surfaces of developing sleeves 62*a* and 62*b*, upper ends of which are held by holders 70*a* and 70*b*, and lower ends of which are urged against the surfaces of developing sleeves 62*a* and 62*b*, respectively. Recovery blades 68*a* and 68*b* recover nonused toners 56*a* and 56*b* from the surfaces of developing sleeves 62*a* and 62*b*, respectively. Note that reference numerals 72*a* and 72*b* denote detectors for detecting the presence/absence of toners 56*a* and 56*b***, respectively.

A developing bias voltage obtained by superposing an AC developing bias voltage of 1.4 to 2.0 kV on a DC developing bias voltage of 200 to 400 V is applied between developing sleeve **62*a* of first developing unit 10 and photosensitive body 4 by first bias power source 74. On the other hand, a DC developing bias voltage of 800 to 1,000 V is applied between developing sleeve 62*b* of second developing unit 16 and photosensitive body 4 by second bias power source 76**.

The diameter of developing sleeve **62*b* of second developing unit 16 is larger than that of developing sleeve 62*a* of first developing unit 10. Therefore, the toner flying area of developing sleeve 62*b* is larger than that of developing sleeve 62*a*. For example, the diameter of developing sleeve 62*b* is 38, 45, or 50 mm, and that of developing sleeve 62*a*** is 30 mm.

Predetermined gaps are respectively provided between photosensitive body 4 and developing sleeve **62*a*, and between photosensitive body 4 and developing sleeve 62*b*. A proper width of the gap set when the DC developing bias voltage is used as the developing bias voltage is different from that set when the developing bias voltage obtained by superposing the AC developing bias voltage on the DC developing bias voltage is used. When the DC developing bias voltage is used as the developing bias voltage, the proper width of the gap may be preferably selected from the range of 50 to 300 μm. When the developing bias voltage obtained by superposing the AC developing bias voltage on the DC developing bias voltage is used, the proper width of the gap may be preferably selected from the range of 80 to 500 μm. In this embodiment, the gap width is 150 μm when the DC developing bias voltage is used, and the gap width is 250 μm when the superposed developing bias voltage is used. That is, the gap width between developing sleeve 62*b* and photosensitive body 4 is 150 μm, and that between developing sleeve 62*a* and photosensitive body 4** is 250 μm.

Figure 4:
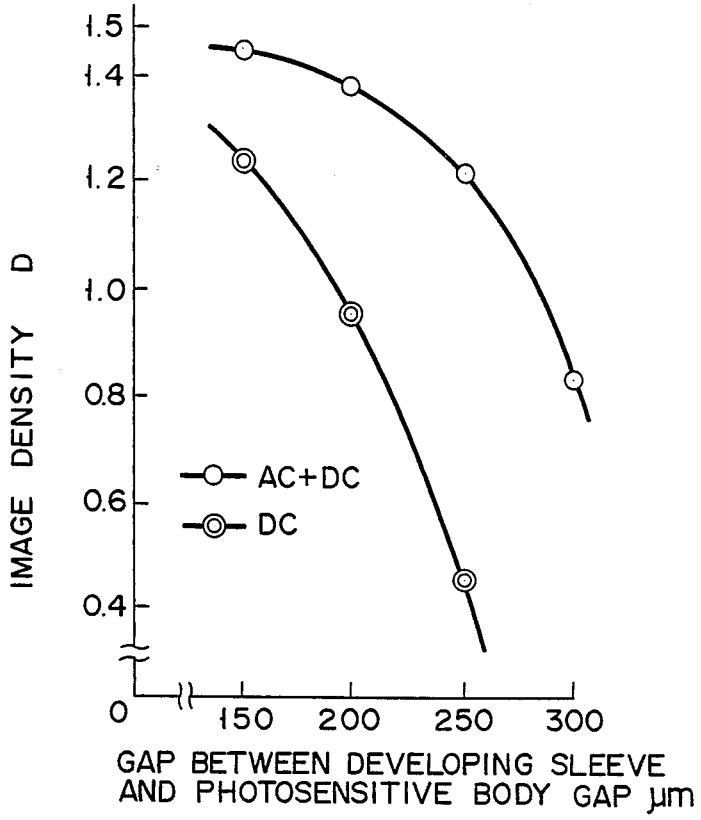
FIG. 4 is a graph showing a relationship between the image density and a gap between a developing sleeve and a photosensitive body.

FIG. 4 shows the relationship between the gap and the image density. As the gap width is decreased, the toner flying distance and the image density are increased. When the DC developing bias voltage (DC) is used as the developing bias voltage, the toner flying distance is short and the image density is low, as compared with a case wherein the superposed developing bias voltage (AC+DC) of DC and AC is used.

During development, toners **56*a* and 56*b* are supplied to developing sleeves 62*a* and 62*b* by rotation of supply rollers 60*a* and 60*b* and then are formed into layers by coating blades 66*a* and 66*b*, respectively. Toners 56*a* and 56*b* are caused to face the latent images on photosensitive body 4 by rotation of developing sleeves 62*a* and 62*b* and to fly from developing sleeves 62*a* and 62*b* to photosensitive body 4** by the developing bias voltage. Thus, the static latent image is developed.

According to the above arrangement, since developing sleeve **62*b* has the diameter of 38, 45, or 50 mm which is larger than that of 30 mm of developing sleeve 62*a*, the curvature of developing sleeve 62*b* is decreased. Therefore, the surface area of developing sleeve 62*a* from which the toner particles fly to photosensitive body 4 is increased. As a result, an amount of toner particles flying from developing sleeve 62*a* to photosensitive body 4** is increased, so that the sufficient image density is obtained.

Figure 5:
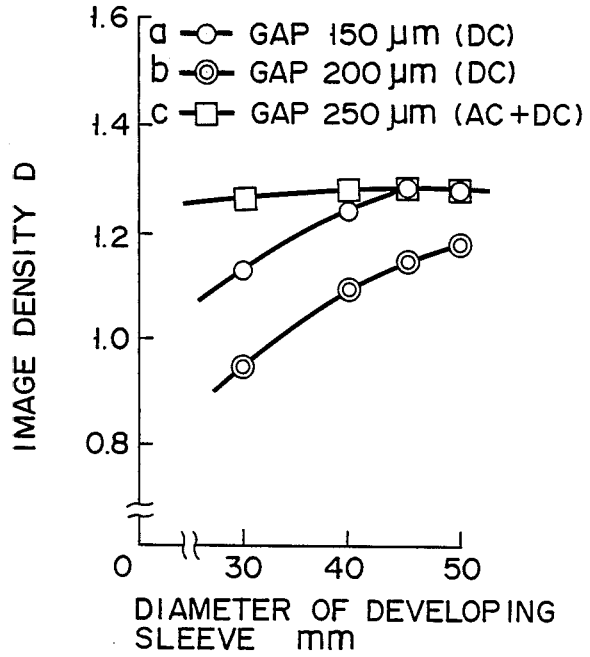
FIG. 5 is a graph showing a relationship between a diameter of the developing sleeve and the image density.

FIG. 5 shows the relationship between the diameter of the developing sleeve and the image density. As the diameter of the developing sleeve is increased, the image density is increased. In FIG. 5, line a represents a case wherein the gap between the photosensitive body and the developing sleeve is 150 μm (the DC developing bias voltage is applied), line b represents a case wherein the gap is 200 μm (the DC developing bias voltage is applied), and line c represents a case wherein the gap is 250 μm (the superposed developing bias voltage of AC and DC is applied). If the diameter of the developing sleeve is 40 mm or more, the image density equal to that obtained when the superposed developing bias voltage of AC and DC is applied can be obtained by selecting the proper gap even when the DC developing bias voltage is applied.

As has been described above, according to the present invention, the toner flying area of developing sleeve 62b is larger than that of developing sleeve 62a. Therefore, if toner flying efficiency per unit area of developing sleeve 62b is lower than that of developing sleeve 62a, an amount of toner supplied from developing sleeve 62b to photosensitive body 4 is the same as that from developing sleeve 62a to photosensitive body 4. As a result, the image density of development performed by developing sleeve 62b is the same as that of development performed by developing sleeve 62a, so that a good image can be obtained.

What is claimed is:

1. A recording apparatus having an image carrier movable in one direction, comprising:

first image-forming means for forming a first electrostatic latent image on said image carrier;

first developing means, located downstream of said first image-forming means with respect to said one direction, for applying a first developing agent on the first electrostatic latent image, said first developing means having a first curved surface with a first curvature so as to carry a layer of the first developing agent thereon and said first developing means being disposed to cause the layer of the first developing agent to face the movable image carrier with a first gap maintained in accordance with the movement thereof;

second image-forming means, located downstream of said first developing means with respect to said one direction, for forming a second electrostatic latent image on said image carrier;

second developing means, located downstream of said second image-forming means with respect to said one direction, for applying a second developing agent on the second electrostatic latent image, said second developing means having a second curved surface with a second curvature less than the first curvature so as to carry a layer of the second developing agent thereon and said second developing means being disposed to cause the layer of the second developing agent to face the movable image carrier in accordance with the movement thereof after the layer of the first developing agent has faced the movable image carrier with a second gap maintained; and bias voltage-applying means for applying an AC developing bias voltage between the image carrier and said first developing means so as to transfer the first developing agent from the first curved surface to the image carrier, and applying a DC developing bias voltage between the image carrier and said second developing means so as to transfer the second developing agent from the second curved surface to the image carrier, whereby the first and second developing agents are overlappingly deposited on the electrostatic latent image.

2. The apparatus according to claim 1, wherein said first developing means has a first rotatable developing sleeve with a first diameter for carrying the layer of the first developing agent thereon; and said second developing means has a second rotatable developing sleeve with a second diameter larger than the first diameter for carrying the layer of the second developing agent thereon.

3. The apparatus according to claim 1, wherein the first developing bias voltage is a developing bias voltage obtained by superposing an AC bias voltage on a DC bias voltage.

4. The apparatus according to claim 1, wherein said second developing means is arranged in a downstream of said first developing means along a moving direction of said image carrier.

5. The apparatus according to claim 1, wherein said image carrier includes a rotatable drum-like photosensitive body.

6. The apparatus according to claim 1, wherein a moving speed of each of said first and second developing means is the same as a moving speed of said image carrier.

7. The apparatus according to claim 1, wherein said first developing means faces said image carrier through a first gap, and said second developing means faces said image carrier through a second gap smaller than the first gap.

8. An apparatus for developing an electrostatic image on a rotatable image carrier, comprising:

a first rotatable member for carrying a substantially non-magnetic toner with a first color on the surface thereof, said first rotatable member facing the rotatable image carrier with a gap and having a first diameter;

a second rotatable member for carrying a substantially non-magnetic toner with a second color different than the first color on the surface thereof, said second rotatable member facing the rotatable image carrier with a gap after said first rotatable member has faced the image carrier and having a second diameter larger than the first diameter;

a first biasing means for applying a first bias voltage which includes an AC component between said first rotatable member and the image carrier so as to cause the non-magnetic toner to reciprocate between them; and second biasing means for applying a second bias voltage which comprises a DC component between said second rotatable member and the image carrier so as to transfer the non-magnetic toner from said second rotatable member to the image carrier, whereby the non-magnetic toner with the first color and the non-magnetic toner with the second color are overlappingly deposited on the electrostatic image.

* * * * *